US005592267A

United States Patent [19]

Misago et al.

[11] Patent Number: 5,592,267

[45] Date of Patent: Jan. 7, 1997

[54] IMAGE FORMING APPARATUS USING FRESH TONER AND USED TONER

[75] Inventors: Naomi Misago; Kazuhisa Sudo, both of Tokyo, Japan

[73] Assignee: Ricoh Company, Ltd., Tokyo, Japan

[21] Appl. No.: 374,901

[22] Filed: Jan. 19, 1995

[30] Foreign Application Priority Data

Jan. 19, 1994 [JP] Japan ..... 6-018984
Nov. 8, 1994 [JP] Japan ..... 6-298831

[51] Int. Cl.[6] ..... G03G 15/08; G03G 21/00

[52] U.S. Cl. ..... 399/62; 399/359

[58] Field of Search ..... 355/246, 298

[56] References Cited

U.S. PATENT DOCUMENTS

| | | | |
|---|---|---|---|
| 4,357,097 | 11/1982 | Koiso | 355/298 |
| 4,894,688 | 1/1990 | Taniguchi et al. | 355/298 |
| 5,260,754 | 11/1993 | Yano et al. | 355/296 |
| 5,268,720 | 12/1993 | Saitoh et al. | 355/298 X |
| 5,307,128 | 4/1994 | Murasaki et al. | 355/298 X |
| 5,386,274 | 1/1995 | Sanpe et al. | 355/215 |
| 5,526,100 | 6/1996 | Misago et al. | 355/246 |

FOREIGN PATENT DOCUMENTS

| | | |
|---|---|---|
| 56-126865 | 10/1981 | Japan . |
| 5-249828 | 9/1993 | Japan . |
| 2265993 | 10/1993 | United Kingdom . |

*Primary Examiner*—Fred L. Braun
*Attorney, Agent, or Firm*— Oblon, Spivak, McClelland, Maier & Neustadt, P.C.

[57] ABSTRACT

In an image forming apparatus, a latent image is electrostatically formed on a photoconductive element and then developed by a developing unit. The developing unit is formed with a used toner inlet for receiving used toner. A cleaning unit removes toner remaining on the photoconductive element after image transfer and thereby collects it as the used toner. A conveying device conveys the used toner from the cleaning unit to the used toner inlet of the developing unit. A toner end sensor is disposed in the developing unit and adjoins the used toner inlet. On determining that the amount of toner existing in the developing unit is less than a predetermined amount, the sensor causes fresh toner to be replenished into the unit.

3 Claims, 6 Drawing Sheets

IMAGE FORMING APPARATUS USING FRESH TONER AND USED TONER

BACKGROUND OF THE INVENTION

The present invention relates to an electrophotographic copier, laser printer, facsimile apparatus or similar image forming apparatus and, more particularly, to an image forming apparatus of the type replenishing, when a toner end sensor indicates that the amount of toner remaining in a developing unit is less than a predetermined amount, fresh toner into the developing unit.

Conventional electrophotographic copiers, for example, include one which collects toner remaining in a photoconductive element after image transfer by a cleaning unit and constantly recirculates the collected toner to a developing unit for recycling it. In this type of copier, the developing unit is provided with a toner end sensor in the vicinity of a fresh toner inlet thereof. The toner end sensor is responsive to the amount of toner remaining in the developing unit. When the amount of toner around the fresh toner inlet decreases to below a predetermined amount, fresh toner is replenished into the developing unit in response to the resulting output of the sensor. At the same time, the collected toner is constantly recirculated into the developing unit via a used toner inlet. This, however, often brings about a problem that when the output of the sensor indicates a toner end condition, toner still exists in more than the predetermined amount around the used toner inlet. In such a condition, if fresh toner is replenished into the developing unit, the toner overflows the unit via the used toner inlet and thereby obstructs the recirculation of the used toner into the unit. This aggravates the aggregation of the toner which would lead to a granular defective image in the event of recycling.

SUMMARY OF THE INVENTION

It is, therefore, an object of the present invention to provide an image forming apparatus which prevents, in the event of replenishing fresh toner into a developing unit, the conveyance of used toner into the unit from being obstructed.

An image forming apparatus of the present invention has a photoconductive element for electrostatically forming a latent image thereon, and a developing unit for developing the latent image by toner. The developing unit is formed with a used toner inlet for receiving used toner. A cleaning unit removes toner remaining on the photoconductive element after image transfer and thereby collects it as the used toner. A conveying device conveys the used toner from the cleaning unit to the used toner inlet of the developing unit. A toner end sensor is disposed in the developing unit and adjoins the used toner inlet. On determining that the amount of toner existing in the developing unit is less than a predetermined amount, the sensor causes fresh toner to be replenished into the unit.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 9:
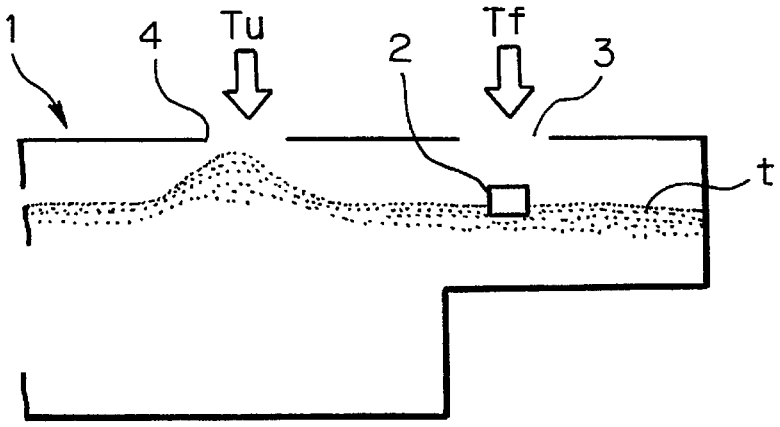
Fig. 9 PRIOR ART
FIG. 9 is a view demonstrating how a conventional electrophotographic copier detects a toner end condition with a toner end sensor.

To better understand the present invention, a brief reference will be made to a conventional toner end sensor included in an electrophotographic copier, shown in FIG. 9. As shown, a developing unit 1 is built in the copier and has a toner end sensor 2 thereinside. The sensor 2 is located in the vicinity of a fresh toner inlet 3 and responsive to the amount of toner t remaining in the developing unit 1. When the amount of toner t around the fresh toner inlet 3 decreases to below a predetermined amount, fresh toner Tf is replenished into the developing unit 1 in response to the resulting output of the sensor 2. At the same time, toner Tu used and collected is constantly recirculated into the developing unit 1 via a used toner inlet 4. It is, therefore, likely that even when the output of the sensor 2 indicates a toner end condition, the toner t exists in more than the predetermined amount around the used toner inlet 4. In such a condition, if fresh toner Tf is replenished into the developing unit 1, the toner overflows the unit 1 via the used toner inlet 4 and thereby obstructs the recirculation of the used toner Tu into the unit 1. This aggravates the aggregation of the toner which would lead to a granular defective image in the event of recycling, as discussed earlier.

Figure 1:
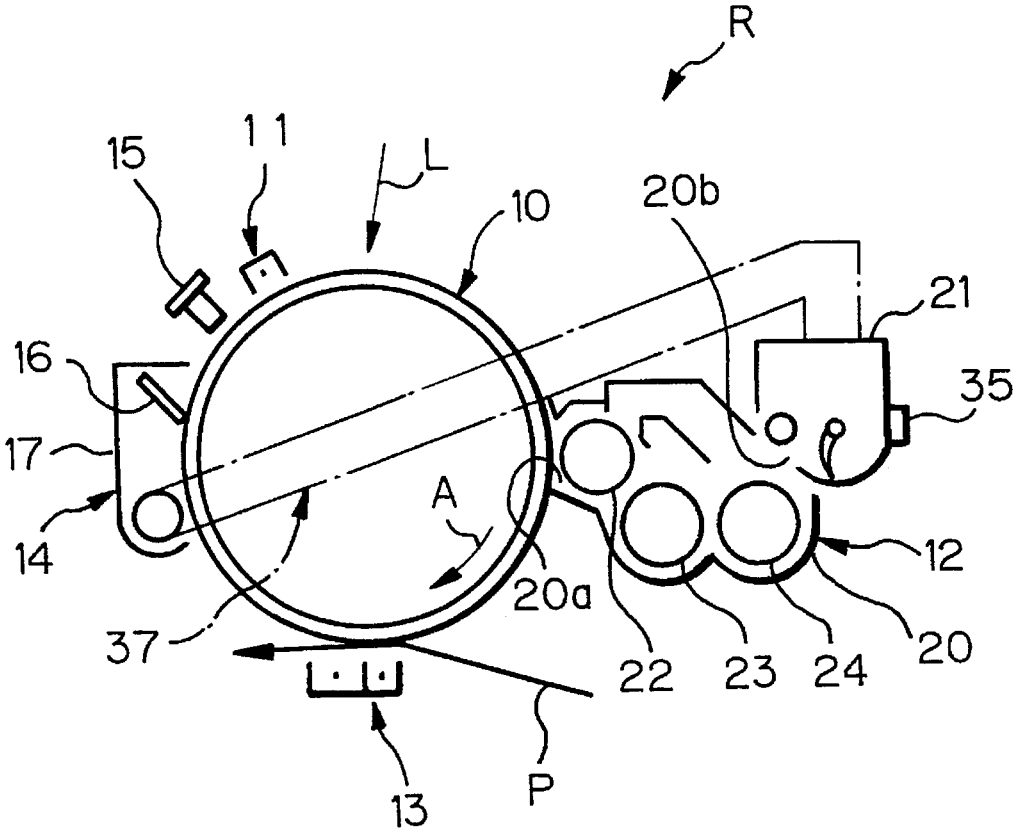
FIG. 1 is a section showing a recording section included in an image forming apparatus embodying the present invention.

Referring to FIG. 1, a recording section included in an image forming apparatus embodying the present invention is shown. The image forming apparatus is implemented as an electrophotographic copier by way of example. As shown, the recording section, generally labeled R, is located substantially at the center of the copier and includes a photoconductive element in the form of a drum 10. The drum 10 is rotatable in a direction indicated by an arrow A in the figure, i.e., clockwise. A charger 11, a developing unit 12, an image transfer unit 13, a cleaning unit 14 and a discharger 15 are sequentially arranged around the drum 10 in this order in the direction A. An optical writing device, not shown, is located above the drum 10. In operation, a paper P is fed from a paper cassette, not shown, to a registration roller pair, not shown. The registration roller pair drives the paper P to below the drum 10 at a predetermined timing. The charger 11 uniformly charges the surface of the drum 10 which is in rotation. A laser beam L, issuing from the writing device, scans the charged surface of the drum 10 so as to form an electrostatic latent image thereon. The developing unit 12 develops the latent image by toner to thereby form a corresponding toner image. The image transfer unit 13 transfers the toner image from the drum 10 to the upper side of the paper P reached the drum 10. The paper P carrying the toner image thereon is conveyed to a fixing unit, not shown. After the toner image has been fixed on the paper P by the fixing unit, the paper P is driven out of the copier. After the image transfer, the toner remaining on the drum 10 is scraped off by a blade 16 disposed in the cleaning unit 14. As a result, this part of the toner is collected in a cleaning case 17. Subsequently, charges also remaining on the drum 10 are dissipated by the discharger 15.

Figure 2:
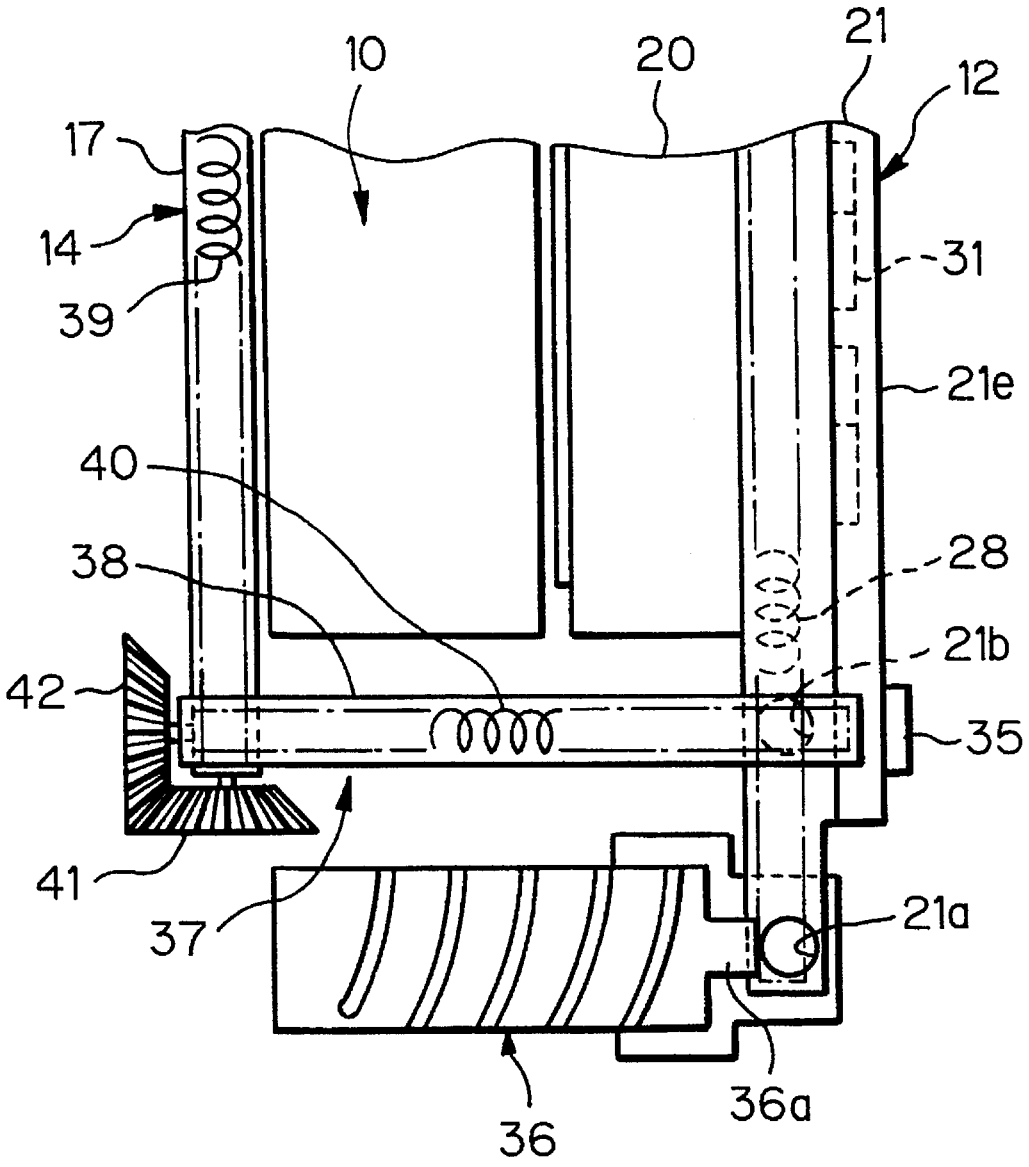
FIG. 2 is a fragmentary plan view of the embodiment and showing an arrangement for collecting used toner and replenishing fresh toner.
Figure 3:
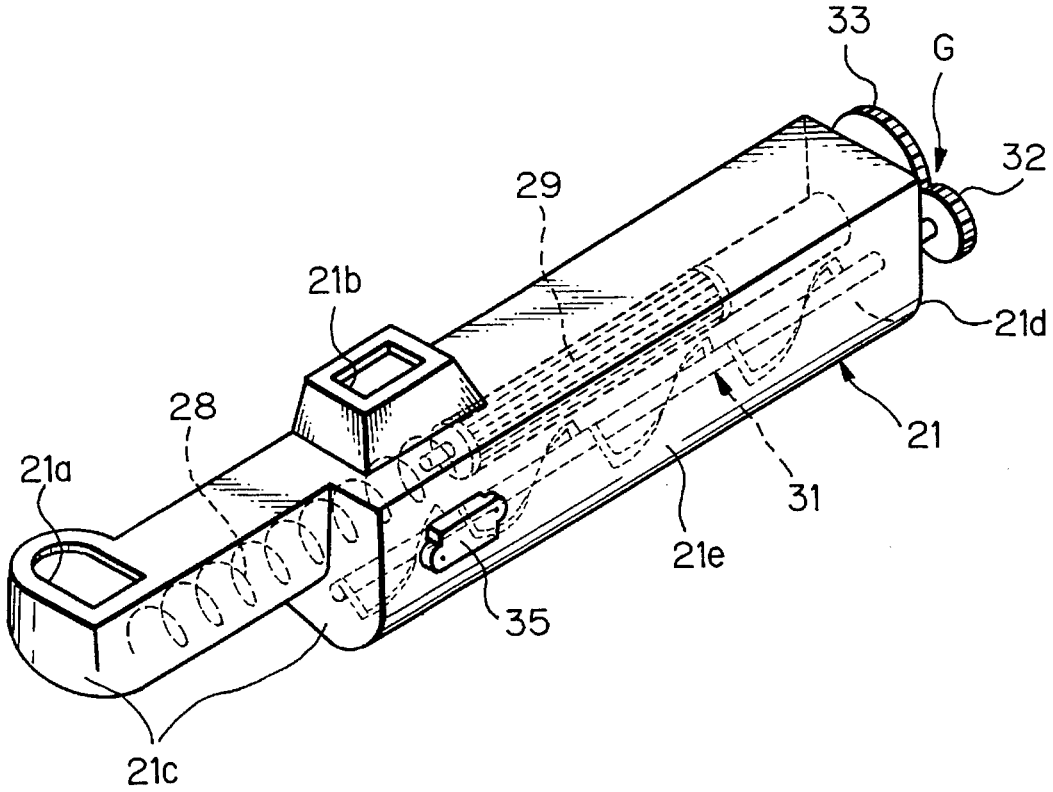
FIG. 3 is a fragmentary perspective view of a developing unit included in the embodiment.

The developing unit 12 has a case 20 and a hopper 21. The case 20 has an elongate box-like configuration extending in the axial direction of the drum 10. An opening 20*a* for development and an opening 20*b* for toner replenishment are formed through the case 20 at the sides adjoining the drum 10 and the hopper 21, respectively. A developing roller 22, a paddle 23 and a supply roller 24 are disposed in the case 20. The hopper 21, like the case 20, is implemented as an elongate box extending in the axial direction of the drum 10. As shown in FIGS. 2 and 3, a fresh toner inlet 21*a* and a used toner inlet 21*b* are formed through part of the upper wall of the hopper 21 which is adjacent to one lengthwise end of the hopper 21. The hopper 21 is communicated to the case 20 by the opening 20*b*, as shown in FIG. 1.

Figure 4:
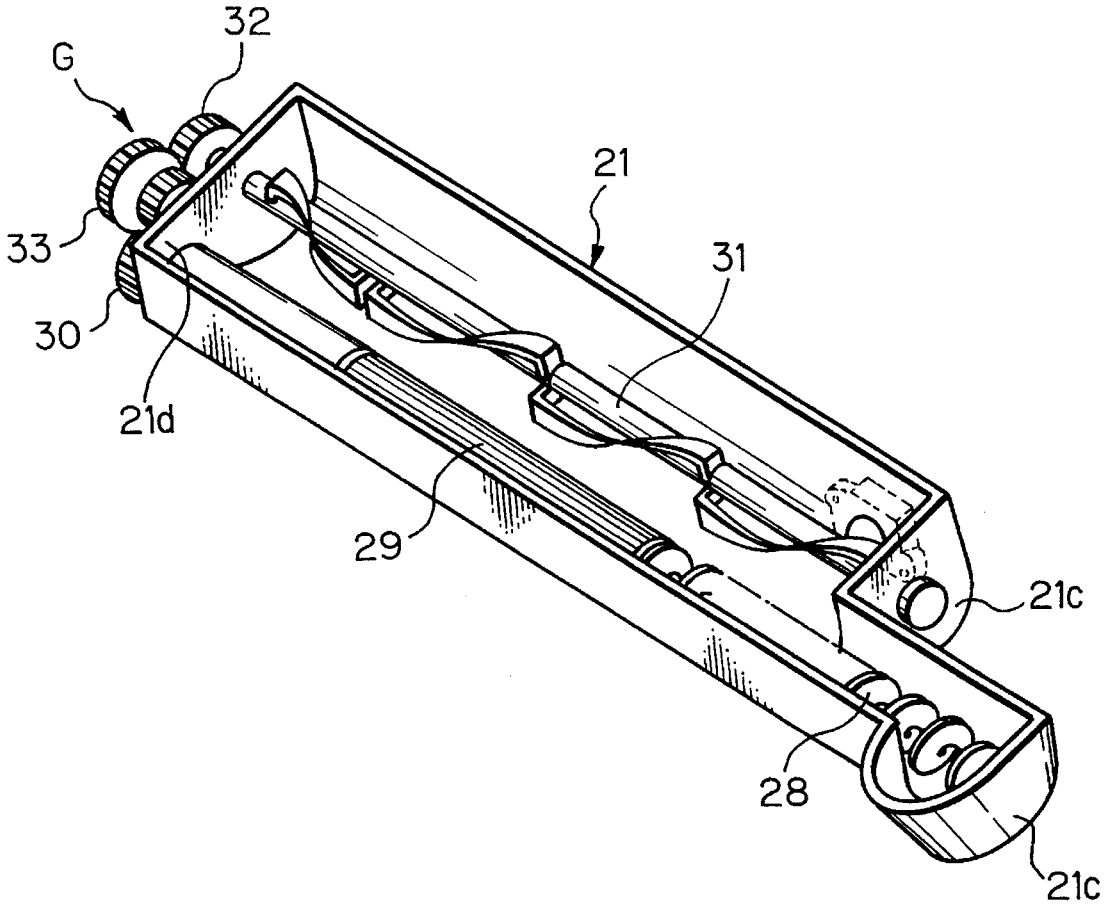
FIG. 4 is a perspective view showing the developing unit in a top-open condition.

A screw 28 is disposed in the hopper 21 and extends from beneath the fresh toner inlet 21*a* to beneath the used toner inlet 21*b*. As also shown in FIG. 4, the screw 28 is rotatably supported by one end wall 21*c* of the hopper 21 at one end thereof. The other end of the screw 28 is connected to one end of the supply roller 29. The other end of the supply roller 29 is rotatably supported by the other end wall 21*d* of the hopper 21 while protruding to the outside from the wall 21*d*. A gear 30 is mounted on the end of the supply roller 29 protruding from the wall 21*d*. An agitator 31 is also positioned in the hopper 21 and extends in parallel to the screw 28 and supply roller 29. The agitator 31 is rotatably supported by the end walls 21*c* and 21*d* at opposite ends thereof. A gear 32 is mounted on one end of the agitator 31 protruding to the outside from the end wall 21*d*. The gears 30 and 32 are held in mesh with a stepped gear 33 which is also rotatably supported by the end wall 21*d*. The gears 30, 32 and 33 constitute a gear train G to which a torque is transmitted from a drive source, not shown.

As shown in FIGS. 2 and 3, the hopper 21 has a bottom wall 21*e* perpendicular to the end walls 21*c* and 21*d* and supporting a toner end sensor 35 thereon. The toner end sensor 35 is located in the vicinity of the used toner inlet 21*b* of the hopper 21. As shown in FIG. 2, a toner bottle 36 is removably mounted on the hopper 21 in the vicinity of the fresh toner inlet 21*a* and rotatably supported by a suitable arrangement. The toner bottle 36 has a mouth 36*a* thereof communicated to the fresh toner inlet 21*a*. A spiral blade is provided on the inner periphery of the toner bottle 36, as illustrated.

In operation, assume that toner in the hopper 21 is consumed to below a predetermined amount by repeated development. Then, the toner end sensor 35 sends an output indicating a toner end condition to control means, not shown. In response, the control means causes the toner bottle 36 to rotate via drive means, not shown. As a result, the spiral blade in the bottle 36 conveys fresh toner Tf filled in the bottle 36 to the mouth 36*a*. The toner Tf is replenished into the hopper 21 via the mouth 36*a* and fresh toner inlet 21*a*. The screw 28 disposed in the hopper 21 conveys the toner Tf deep into the hopper 21.

As shown in FIG. 2, the copier additionally has a toner conveying device 37 for recirculating the toner collected by the cleaning unit 14 to the developing unit 12. The toner conveying device 37 has a conduit 38 which is communicated at one end to the cleaning case 17 and at the other end to the used toner inlet 21*b*. Screws 39 and 40 are respectively disposed in the cleaning case 17 and the conduit 38, and each is rotatably supported. Gears 41 and 42 are respectively mounted on one end of the screw 39 and one end of the screw 40 and held in mesh with each other.

As a torque is transmitted from a drive source, not shown, to the screw 39, the screw 39 rotates the screw 40 via the intermeshing gears 41 and 42. In this condition, the used toner collected by the cleaning unit 14 is conveyed to the used toner inlet 21*b* by the screws 39 and 40. As a result, the used toner is constantly fed into the hopper 21 while the copier is in operation. Hence, the toner level in the hopper 21 is maintained constant on the basis of the output of the toner end sensor 35 which takes the amount of collected toner into account.

Figure 5:
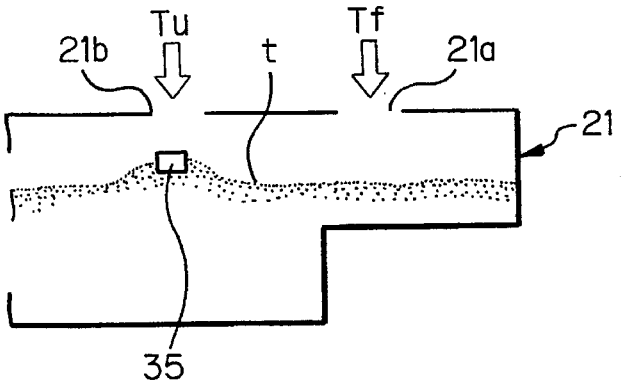
FIG. 5 shows the developing unit together with a toner end sensor disposed therein.

More specifically, as shown in FIG. 5, assume that the amount of toner t existing in the hopper 21 is less than a predetermined amount around the used toner inlet 21*b*, as determined by the toner end sensor 35. Then, fresh toner Tf is replenished from the toner bottle 36 into the hopper 21, as stated earlier. In the figure, used toner recirculated from the cleaning unit 14 to the hopper 21 is labeled Tu.

Figure 6:
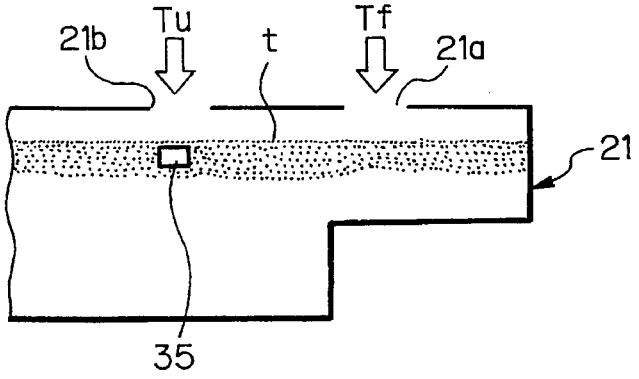
FIG. 6 is a view similar to FIG. 5, showing the toner end sensor located at a raised position in order to maintain a toner end level high.
Figure 7:
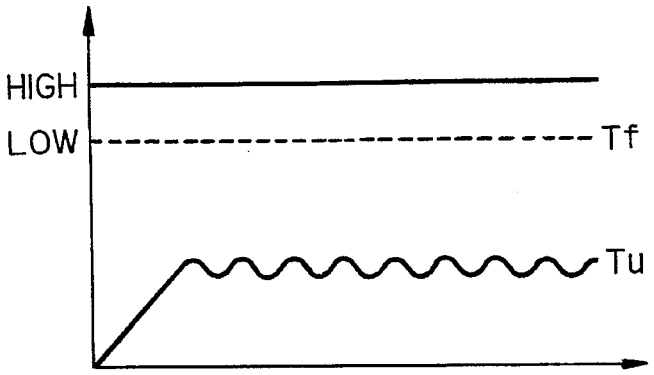
FIG. 7 is a graph indicating how the proportion of used toner to the entire toner existing in the developing unit changes with a change in toner end level.
Figure 8:
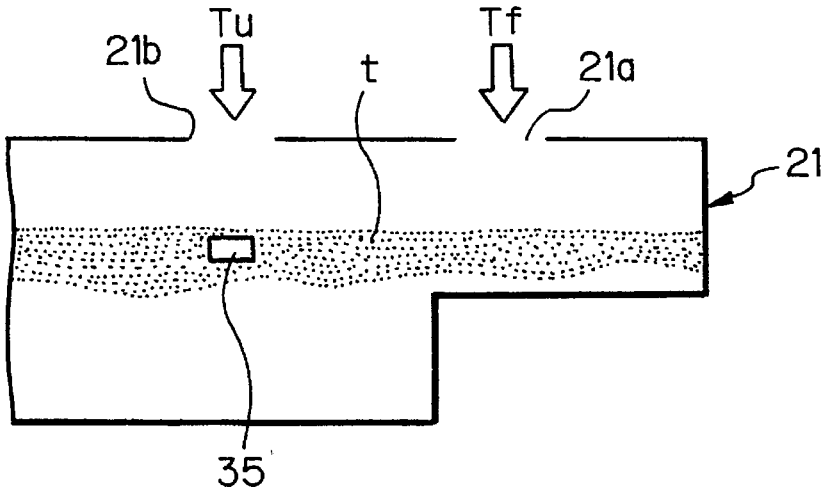
FIG. 8 is view similar to FIG. 5, showing the toner end sensor located at a lowered position in order to maintain the toner end level low.

In the illustrative embodiment, the toner end sensor 35 is selectively movable to a raised position or a lowered position in order to change the toner end level in the hopper 21. As shown in FIG. 6, when the sensor 35 is located at a raised position, the toner end level is maintained high. In this condition, the amount of fresh toner Tf increases relative to the amount of used toner Tu which substantially remains constant, as indicated by a solid line in FIG. 7. Conversely, as shown in FIG. 8, when the sensor 35 is brought to a lowered position, the toner end level is maintained low. As a result, the amount of fresh toner Tf decreases relative to the amount of used toner Tu, as indicated by a dashed line in FIG. 7. Therefore, when the sensor 35 is located at the raised position, the proportion of the used toner Tu to the entire toner t is reduced. This successfully prevents image quality from being lowered.

In summary, it will be seen that the present invention provides an image forming apparatus having a toner end sensor in the underlying vicinity of a used toner inlet formed in a developing unit. When the amount of toner around the used toner inlet is short as determined by the sensor, fresh toner is replenished into the developing unit. The apparatus, therefore, feeds an adequate amount of fresh toner into the developing unit while taking the amount of used toner into account. Hence, the fresh toner prevents toner existing in the developing unit from overflowing via the used toner inlet and obstructing the recirculation of used toner.

Various modifications will become possible for those skilled in the art after receiving the teachings of the present disclosure without departing from the scope thereof.

What is claimed is:

1. An image forming apparatus comprising:

a photoconductive element for electrostatically forming a latent image thereon;

a developing unit for developing the latent image by toner, said toner consisting essentially of fresh toner and used toner, and said developing unit provided with a used toner inlet for receiving said used toner;

a cleaning unit for removing said toner remaining on said photoconductive element after image transfer and thereby collecting the used toner;

conveying means for conveying the used toner from said cleaning unit to said used toner inlet of said developing unit where the used toner is constantly fed through the used toner inlet; and a toner end sensor for determining that an amount of toner existing in said developing unit is less than a predetermined amount and causing fresh toner to be replenished into said developing unit based on the amount determined, said toner end sensor disposed in said developing unit adjoiningly positioned to underlie said used toner inlet such that the toner end sensor senses a combined amount of used toner fed to the developing unit through the used toner inlet and fresh toner in said developing unit before causing fresh toner to be replenished in the developing unit.

2. An apparatus as claimed in claim 1, wherein said toner end sensor is selectively movable to a raised position or a lowered position in the vicinity of said used toner inlet in order to change a toner end level.

3. The image forming apparatus of claim 1, wherein said developing unit further comprises a fresh toner inlet for receiving said fresh toner, said fresh toner inlet and said used toner inlet positioned in an upper portion of the developing unit at a same height as one another.

* * * * *